United States Patent [19]

Holland

[11] Patent Number: 4,658,935

[45] Date of Patent: Apr. 21, 1987

[54] DIGITAL SELECTOR SYSTEM FOR ELEVATORS

[75] Inventor: Gordon A. Holland, Memphis, Tenn.

[73] Assignee: Dover Corporation, New York, N.Y.

[21] Appl. No.: 762,571

[22] Filed: Aug. 5, 1985

[51] Int. Cl.[4] ..... B66B 1/30

[52] U.S. Cl. ..... 187/122

[58] Field of Search ..... 187/29

[56] References Cited

U.S. PATENT DOCUMENTS

| | | | |
|---|---|---|---|
| 3,526,300 | 9/1970 | Ferrot | 187/29 R |
| 3,589,474 | 6/1971 | Wavre | 187/29 R |
| 3,750,850 | 8/1973 | Winkler | 187/29 R |
| 3,773,146 | 11/1973 | Dixon, Jr. et al. | 187/29 R |
| 3,774,729 | 11/1973 | Winkler | 187/29 R |
| 4,039,049 | 8/1977 | Yoneda et al. | 187/29 R |
| 4,124,103 | 11/1978 | Otto et al. | 187/29 R |
| 4,128,142 | 12/1978 | Satoh et al. | 187/29 R |
| 4,142,609 | 3/1979 | Tachino | 187/29 R |
| 4,155,426 | 5/1979 | Booker | 187/29 R |
| 4,220,221 | 9/1980 | Gingrich | 187/29 R |
| 4,337,847 | 7/1982 | Schroder et al. | 187/29 R |
| 4,351,416 | 9/1982 | Terazono et al. | 187/29 R |
| 4,354,576 | 10/1982 | Kajiyama | 187/29 R |
| 4,367,811 | 1/1983 | Yoneda et al. | 187/29 R |
| 4,389,631 | 6/1983 | Kajiyama et al. | 340/21 |
| 4,456,096 | 6/1984 | Kajiyama | 187/29 R |
| 4,469,199 | 9/1984 | Polis et al. | 187/29 R |
| 4,470,482 | 9/1984 | Husson | 187/29 R |
| 4,515,247 | 5/1985 | Caputo | 187/29 R |

*Primary Examiner*—William M. Shoop, Jr.
*Assistant Examiner*—W. E. Duncanson, Jr.
*Attorney, Agent, or Firm*—Brumbaugh, Graves, Donohue & Raymond

[57] ABSTRACT

An elevator system includes a digital selector system with position indicators in the hatch to provide signals indicative of nearest floor and signals when the car is level with a floor. At initiation of a run, the nearest floor is selected as target floor, and target distance, stored as an absolute distance between floors, is retrieved. Target distance is decremented as the car moves, by signals from a pulse generator. At periodic time intervals, ideal velocity is read from an acceleration look-up table, and used, along with the actual instantaneous target distance, to calculate a slowdown profile of velocity and distance for decelerating the car to the contract deceleration rate. The calculated profile is compared with a stored deceleration look-up table to determine critical car distances for making stopping decisions. The target floor and target floor distance advance, at critical car distances, one floor at a time until a stop call is received at a target floor. The instantaneous target distance is corrected during the run responsive to receipt of actual car position signals.

17 Claims, 20 Drawing Figures

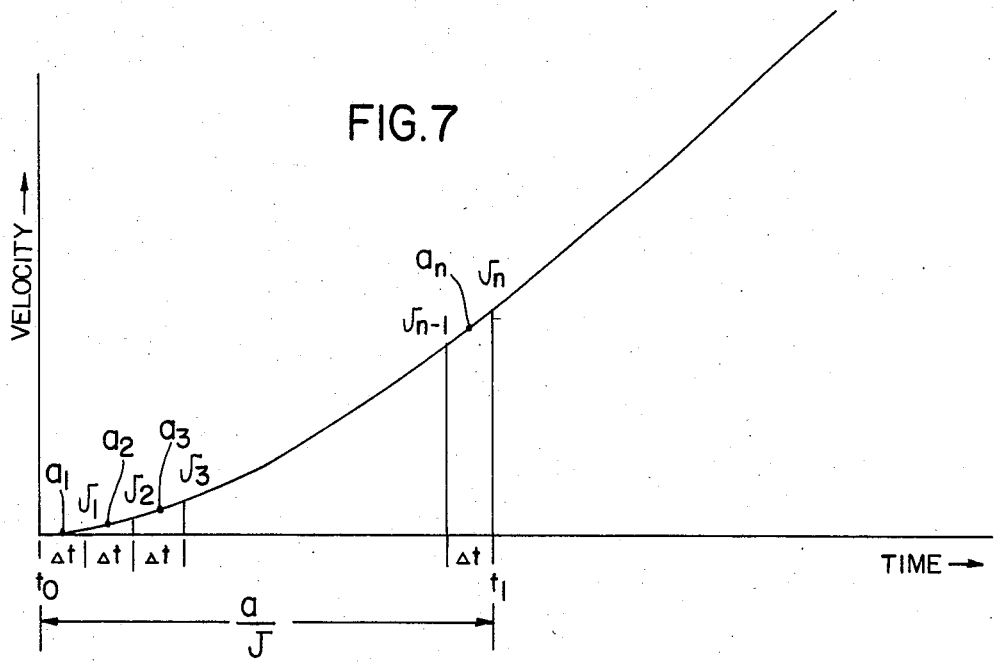
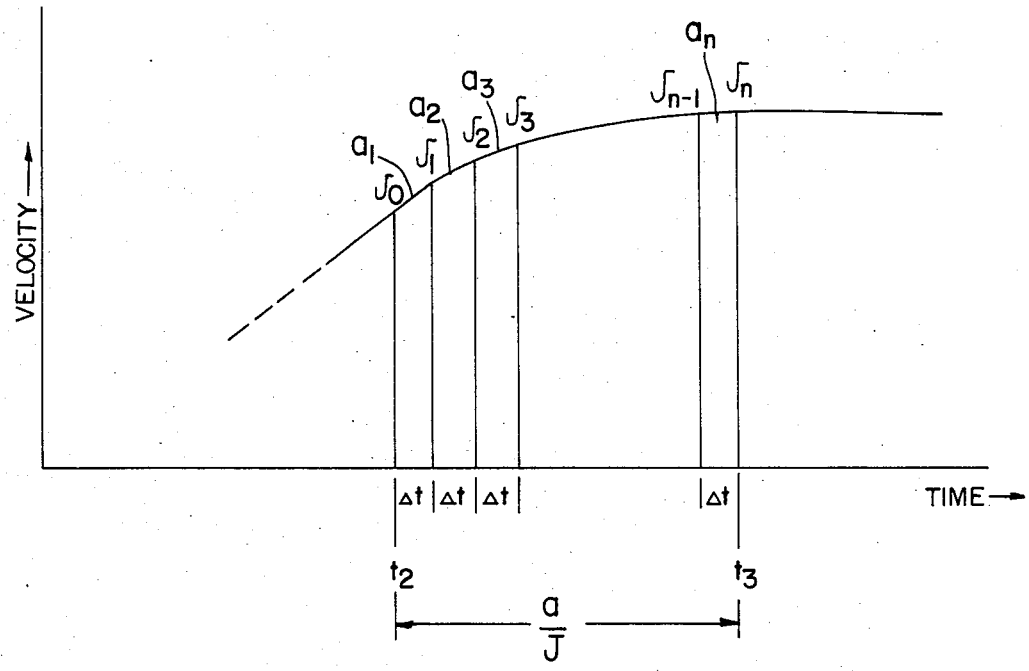
FIG.8

VELOCITY $v_n$
$d_n$
$v_{n-1}$
$v_3$
$v_2$
$v_1$
$v_L$
$d_3$
$d_2$
$d_1$
$S_n$
$S_3$
$S_2$
$S_1$
TIME
$\Delta t_n$
$\Delta t_3$
$\Delta t_2$
$\Delta t_1$
$t_6$
$t_7$
$\frac{d}{J}$ VELOCITY
RATED CONTRACT SPEED
$v_n$
$d_n$
$v_{n-1}$
$v_3$
$v_2$
$v_1$
$d_3$
$d_2$
$d_1$
$v_0$ $S_n$
$S_3$
$S_2$
$S_1$
TIME
$\Delta t$
$\Delta t$
$\Delta t$
$\Delta t$
$t_4$
$\frac{d}{J}$
$t_5$ FIG. 11
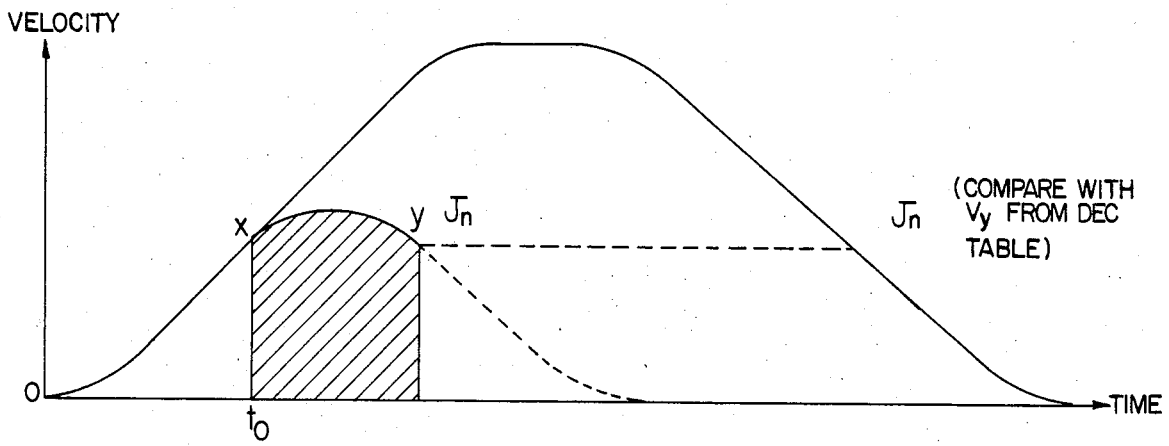
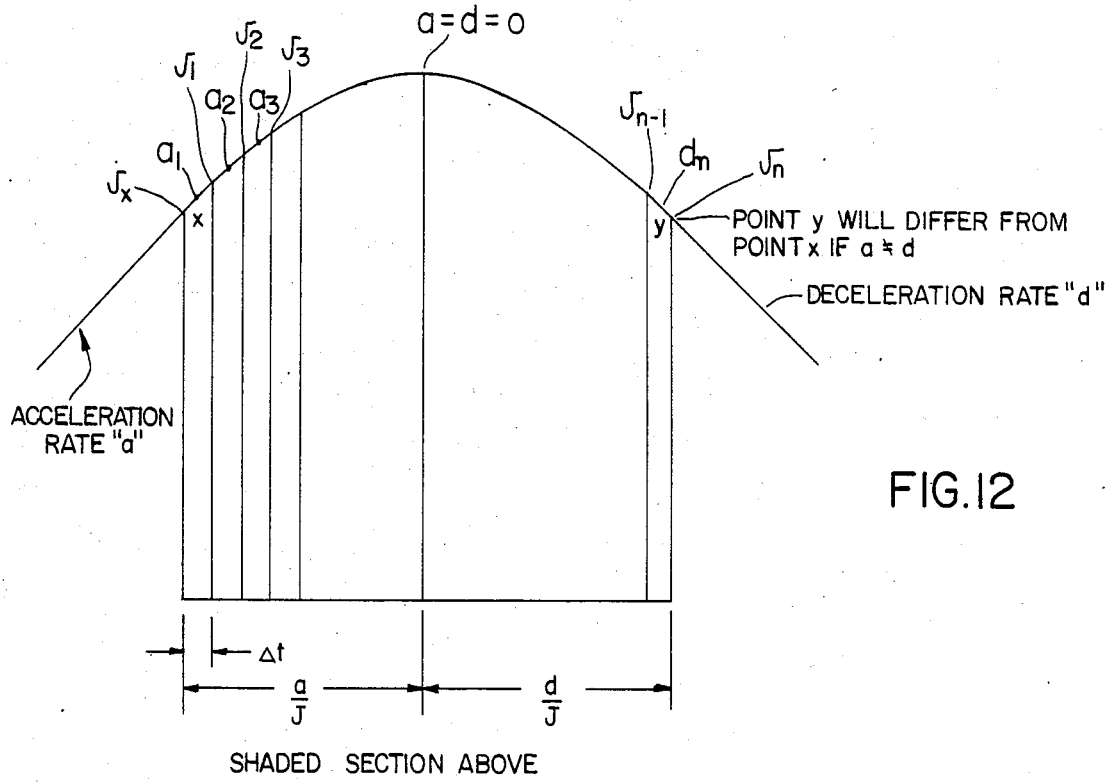
FIG. 12

DIGITAL SELECTOR SYSTEM FOR ELEVATORS

BACKGROUND OF THE INVENTION

The present invention relates to a selector system for controlling the movement of elevator cars. In particular, the present invention is an elevator having an improved digital selector system.

Digital selectors possess many advantages over the mechanical selectors used in the past, and are for such reason preferred in many types of modern elevator installations. Known digital selectors include a device that generates pulses indicative of a given increment of car motion, such as 0.01 foot. A reversible counter stores, as a binary number measured in units of the same incremental distance (for example, 0.01 feet), the instantaneous car position relative to an arbitrary zero position, such as the lowest landing served. As the car moves and pulses are generated, the pulses are supplied to the reversible counter, which adds or subtracts pulses from the count, depending upon the direction of car movement, to change the stored car position.

The elevation of each floor is stored in memory as a binary number representing the distance from the same zero reference to the particular floor, measured in the same increments of distance (0.01 foot, in this example) as the instantaneous car position. The digital numbers representing floor elevation, and the digital number representing instantaneous car position, can then be manipulated by a microprocessor or other solid state control to perform normal selector functions, such as direction selection and call pick-up and cancelling, and provide position indicators and other signals and the position-controlled slowdown signals.

The most common problems encountered with digital selectors are those caused by spurious electrical noise, which can change the count in the reversible counter, and those caused by power interruptions, which can cause a total loss of count. When such occurs, the stored value representative of elevator car position is erroneous and remains so until corrected, which can usually only be done by sending the car back to ground floor level to reset the counter to zero. Many solutions have been proposed to detect such failures and correct the count without resorting to sending the car back to the lowest landing. However, it would be desirable to minimize or eliminate this problem.

There are also many known methods for controlling the starting, stopping, and floor selection functions of the elevator car. It would be desirable to provide a readily programmable processing system to control these functions with selectable inputs and operating parameters.

SUMMARY OF THE INVENTION

The present invention is an elevator system containing an improved digital selector.

In a preferred embodiment of a digital selector system in accordance with the invention, a pulse generator is operatively connected with the car for producing pulse signals representing incremental distances traveled by the car. The system includes a plurality of indicators positioned within the elevator hatchway, and a detector mounted on the elevator car for sensing instantaneous position of the car when in registry with one of the position indicators. Preferably, one set of indicators is placed between adjacent floors to provide signals representative of "synchronous position", i.e. nearest floor, and indicators are provided at each floor to give "car level" signals when the car is level with a floor. By using both signals, it is possible to determine an exact location of the car as it passes a floor.

The digital selector includes a control means, preferably a microprocessor controller. The microprocessor stores, as absolute values in units corresponding to pulse distances, the distances between adjacent floors. It also stores acceleration and deceleration look-up tables, the former containing ideal velocities versus time, and the latter containing ideal velocities versus stopping distances. Each table is based upon selected values of jerk rate, acceleration rate, contract speed, deceleration rate, and landing speed.

The microprocessor is programmed to set, as an initial target floor, the next-adjacent floor in the desired direction of car travel, responsive to a signal indicative of the initiation of a run. This signal may be the receipt of a hall call or car call, or may be generated by the group supervisor unit. The direction of travel may be provided by a conventional direction selection circuit. The microprocessor also determines target distance, as the distance between the present floor and target floor, stored in memory.

As the car begins its run, the microprocessor controller decrements the target distance responsive to the generation of pulses. It also periodically reads the ideal car velocity from the look-up table. The velocity value is fed as a desired speed signal to the speed control section of the hoist machine. It is also used by the microprocessor to determine if the car is at a critical distance from the target floor for making a stopping decision.

Based on ideal velocity, the microprocessor determines the car slowdown distance for decelerating the car, at the selected rate of jerk, to the selected deceleration rate. The controller also calculates the slowdown car velocity, that is, the velocity the car would be travelling when it reaches selected deceleration, and calculates a slowdown table of ideal car velocities versus distances for the car slowdown distance.

The microprocessor then determines a stopping target distance, that is, the distance remaining between the car and the target floor at the time the car would reach selected deceleration, by subtracting the calculated slowdown distance from the instantaneous target distance. The value of ideal velocity, taken from the deceleration look-up table, at the stopping target distance, is compared with the calculated slowdown car velocity to identify critical distances for making stopping decisions (ideal velocity equals slowdown car velocity).

In the event the car has not reached a critical distance (slowdown car velocity is less than ideal velocity), the microprocessor begins recalculating car slowdown distances, slowdown tables, and car slowdown velocities, based upon updated car velocities (from the acceleration look-up tables), and recalculating ideal stopping velocities (based on updated instantaneous target distances), until a critical car distance is reached.

At the critical car distance, the microprocessor determines whether a stop call has been registered at the target floor. Absent a call, the microprocessor advances the target floor to the next adjacent floor, retrieves from memory the distance to the new target floor, and adds such distance to the instantaneous target distance.

If a call is registered at the target floor (or the target floor is the top floor), the microprocessor issues signals to the speed control section of the hoist machine for initiating and controlling slowdown, such signals being taken first from the slowdown table, until the car reaches constant deceleration, and thereafter from the deceleration look-up table.

Preferably, each time the microprocessor receives a "car level" signal, which indicates that the car is within ½" of the subject floor, it recalculates target distance to correct for any spurious noise or other errors (due, for example, to rope slippage). If desired, the microprocessor also can (continuously or periodically) count pulses as the car travels between floors, to correct the stored values of the respective floor heights.

The indicators for signalling synchronous car position are preferably a series of indicators mounted between floors for generating a binary code representative of nearest floor. This may be done with a series of magnets or vanes mounted in the hatchway for producing a binary code and corresponding sensors mounted on the elevator car. In addition, signals are produced when the car is level with a floor.

Floor landings are preferably numbered by a field code, such that each floor differs by only one digit from the floor above or below it. Accordingly, only one indicator element needs to be provided, for changing the one binary digit between floors.

In a preferred embodiment, the microcomputer includes a program for generation of an acceleration look-up table and a deceleration look-up table. Upon installation of the system, or at any time desired thereafter, the operator may program the system to calculate the accleration lookup table based upon the selected rates of acceleration, jerk, and maximum velocity. For such values, the microcomputer program generates a table of ideal velocities at a specified number of time increments, up to the velocity maximum.

At the time the operating parameters are selected, the microcomputer preferably also generates the deceleration table, such table being based upon the selected values of maximum velocity, landing speed, jerk, and deceleration. The table includes calculated values of theoretical stopping velocities at a plurality of selected distances.

A selector system in accordance with the invention minimizes the flight time between starting and terminating positions for any selected amount of travel and combination of selected maximum velocity, landing velocity, acceleration and rate of change of acceleration of a movable body. It also allows the moving car to respond to a signal to stop or decelerate while accelerating or at maximum velocity up to the last possible instant that the body can respond to that signal within the stated constraints of set jerk and deceleration rates. The system accommodates any travel of an elevator between landings over any length of total travel, and generates the input position signals to a microprocessor that are needed to calculate a position versus velocity pattern signal, with hardware that is simple, rugged, economical, and easy to install.

A selector system according to the invention produces elevator position signals in a form that is compatible with the functions required by an elevator control, such as direction selection, illumination of direction and position signal lamps, hall and car call cancelling, and speed control, etc. It also produces a position memory that allows immediate resumption of elevator service after a power interruption without the need to return the car to a selected station to reset the position sensor to a known value.

BRIEF DESCRIPTION OF THE DRAWINGS

FIG. 4(*b*) is a perspective, schematic view of a sensor for reading the vanes shown in FIG. 4(*a*);

FIG. 4(*c*) is a perspective, schematic view of an arrangement of vanes and sensors mounted in an elevator arrangement;

FIGS. 7 and 8 are graphs illustrating a computer-based generation of an acceleration table for use in operating an elevator system in accordance with the invention;

FIGS. 11 and 12 are graphs illustrating computer-based calculation of instantaneous stopping distance in accordance with the invention.

DETAILED DESCRIPTION OF THE PREFERRED EMBODIMENTS

Figure 1:
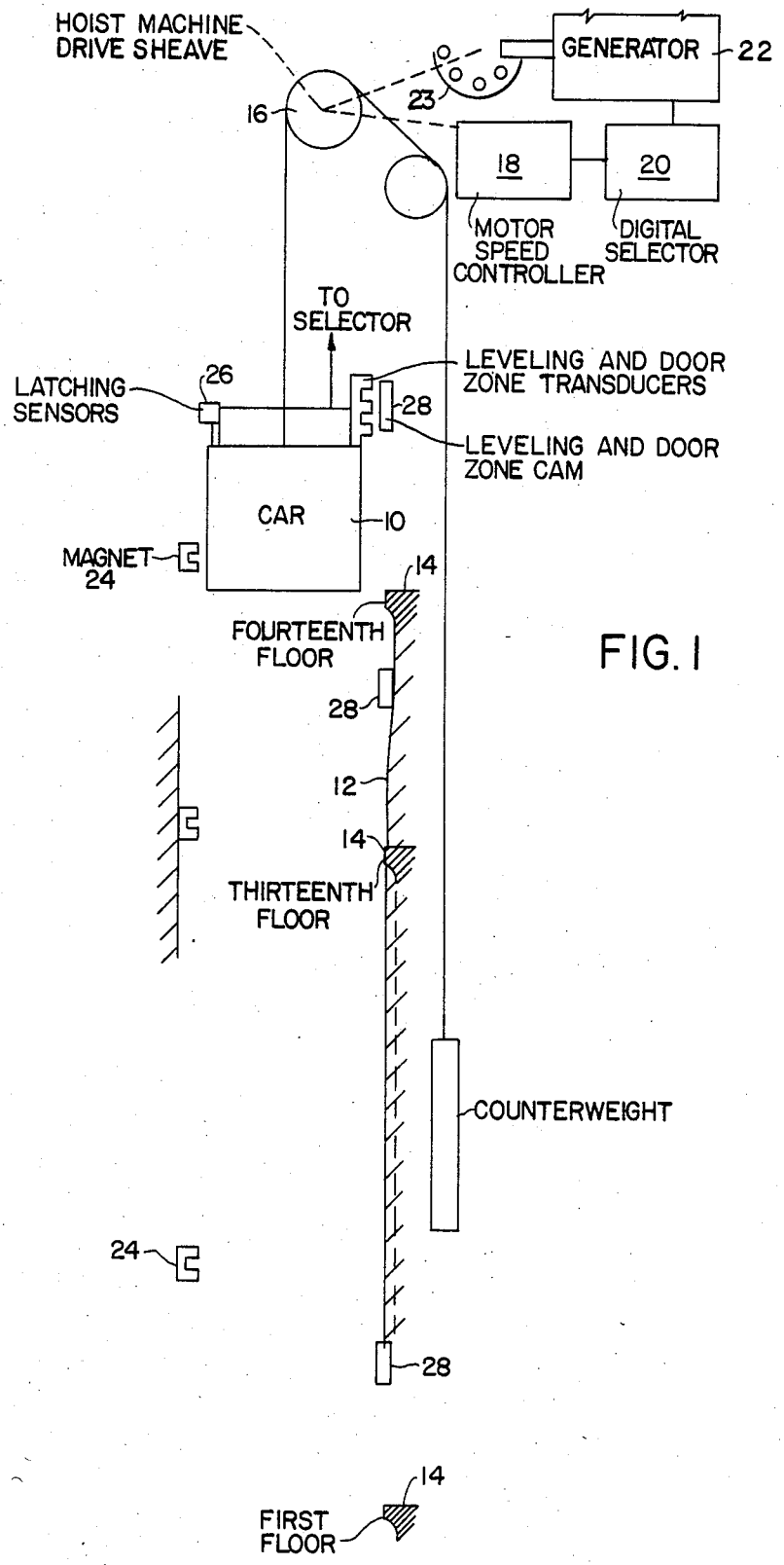
FIG. 1 is a schematic representation of an elevator system in accordance with the invention.

The elevator system depicted in FIG. 1 includes a car 10 mounted in a hoistway 12. The car 10 is moved between landings 14 by a hoist machine, indicated schematically at 16, having a speed controller 18. Operation of the speed controller and hoist machine is, in turn, controlled by a digital selector 20.

A pulse generator 22 includes a rotatable pulse wheel 23 to generate a train of pulses, responsive to car movement, indicative of defined increments of car travel, for example 0.5 inch. Pulse generators, and means for connecting the same to respond to car movement, are common to virtually all digital selectors. The pulse generator 22 may be rotationally coupled to the hoist machine 16, as shown schematically. Alternatively, a cable may be connected between the car and the rotating pulse wheel of the generator 22 to drive the generator in response to car movements. The pulse signal can be produced by an incremental encoder, or any photoelectric or magnetic transducer that can sense a pattern of holes or gear teeth, etc., that rotate in response to car motion.

A plurality of position indicators 24, which are described below, are positioned in the hatch 12 and cooperate with a sensor arrangement 26 on the car 10 for producing a "synchronous position" signal, which is a coded signal identifying the nearest floor. Preferably the indicators 24 are mounted between floors so that the floor code changes abruptly when the car is approximately halfway between floors, to indicate the next approaching floor.

Finally, position indicators 28 are mounted at each floor which cooperate with a sensor 30 mounted on the car 10 to produce a "car level" signal whenever the car is level with a landing. Preferably, the "car-level" signal is obtained from the existing car leveling device. Alternatively, the "car level" signal can be produced by a dedicated sensor operated by a device mounted opposite each landing.

Synchronous Position Code

The sensors 26 and indicators 24 are arranged to generate a unique, multi-bit number, dependent upon elevator direction of movement, at each indicator location, to indicate the next-approaching floor. Preferably, the building floor numbers are assigned in a "grey code" sequence, such that each digital number in the sequence differs from the preceeding number, and the number after it, by only a single digit. As an example, the floors in a building may be numbered as follows:

| FLOOR NUMBER | CORRESPONDING BINARY NUMBER | GREY CODE |
|---|---|---|
| 0 | 0000 | 0000 |
| 1 | 0001 | 0001 |
| 2 | 0010 | 0011 |
| 3 | 0011 | 0010 |
| 4 | 0100 | 0110 |
| 5 | 0101 | 0111 |
| 6 | 0110 | 0101 |
| 7 | 0111 | 0100 |
| 8 | 1000 | 1100 |
| 9 | 1001 | 1101 |
| 10 | 1010 | 1111 |
| 11 | 1011 | 1110 |
| 12 | 1100 | 1010 |
| 13 | 1101 | 1011 |
| 14 | 1110 | 1001 |
| 15 | 1111 | 1000 |

The number of bits required for numbering the floors in a building depends on the number of floors served. If zero is not used as a floor number, 3 bits can designate up to 7 floors, 4 bits can designate up to 15 floors, and 5 bits could designate up to 31 floors.

Figure 2:
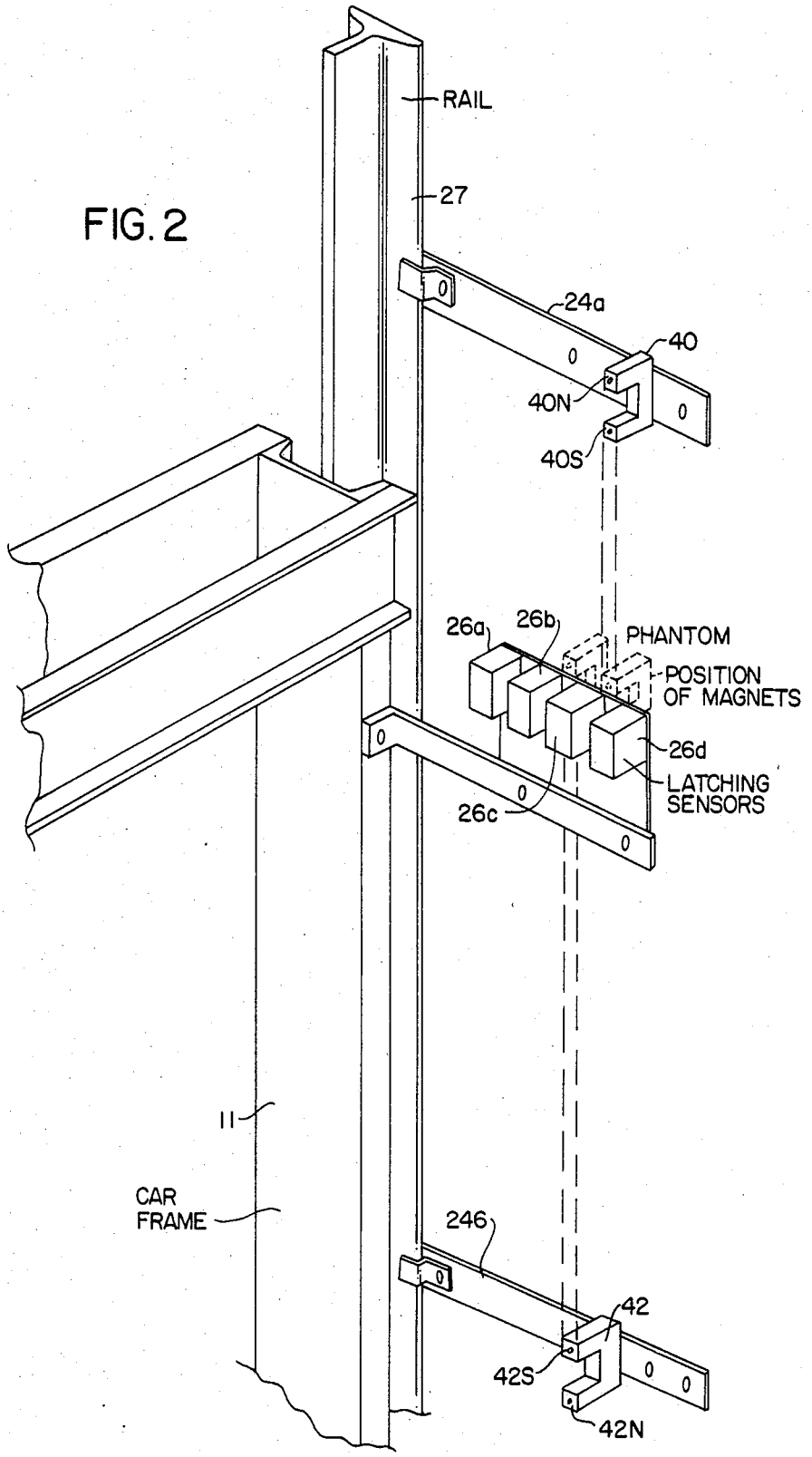
FIG. 2 is a perspective schematic view of a portion of the elevator system of FIG. 1, showing one embodiment of a sensor arrangement.

FIG. 2 illustrates one embodiment of a sensor arrangement for generating a 4-bit grey code to identify floors. Four sensors 26*a–d* are mounted on the elevator car frame 11 so that each probes a different vertical lane in the hatch. Indicator devices 24*a*, 24*b* are mounted stationary in the hatch, halfway between adjacent pairs of floors. As shown, the indicator devices 24*a*, 24*b* are mounted on one of the elevator guide rails 27, and include indicator elements, two such elements, 40, 42, being shown by way of illustration, positioned to be sensed by one of the four sensors 26*a–d* on the car. Preferably, the indicators 40, 42 are inert, for economy and ease of installation, and do not require power (such as an LED, lamp, or electro-magnet). The indicator should also be capable of producing two different outputs from the sensor depending upon direction of car movement. Alternatively, a pair of indicators producing different outputs from the sensor, may be positioned above one another so that opposite outputs are produced, dependent upon direction of car movement.

In the preferred embodiment, the sensor 26*a–d* is a latching Hall effect transducer, and the indicators 40, 42, are permanent magnets. Each magnet is positioned vertically to engage one sensor element, 26*a*, 26*b*, 26*c*, or 26*d*. Also, each magnet is arranged so that both the north and south poles activate the sensor. The opposite poles engage the sensor sequentially, and the magnets produce opposite outputs from the sensor elements depending upon which direction the car is moving, north pole 40N, 42N causing a positive (logic 1) output form the Hall effect transducer, and south pole 40S, 42S producing a negative (logic 0) output.

Figure 3:
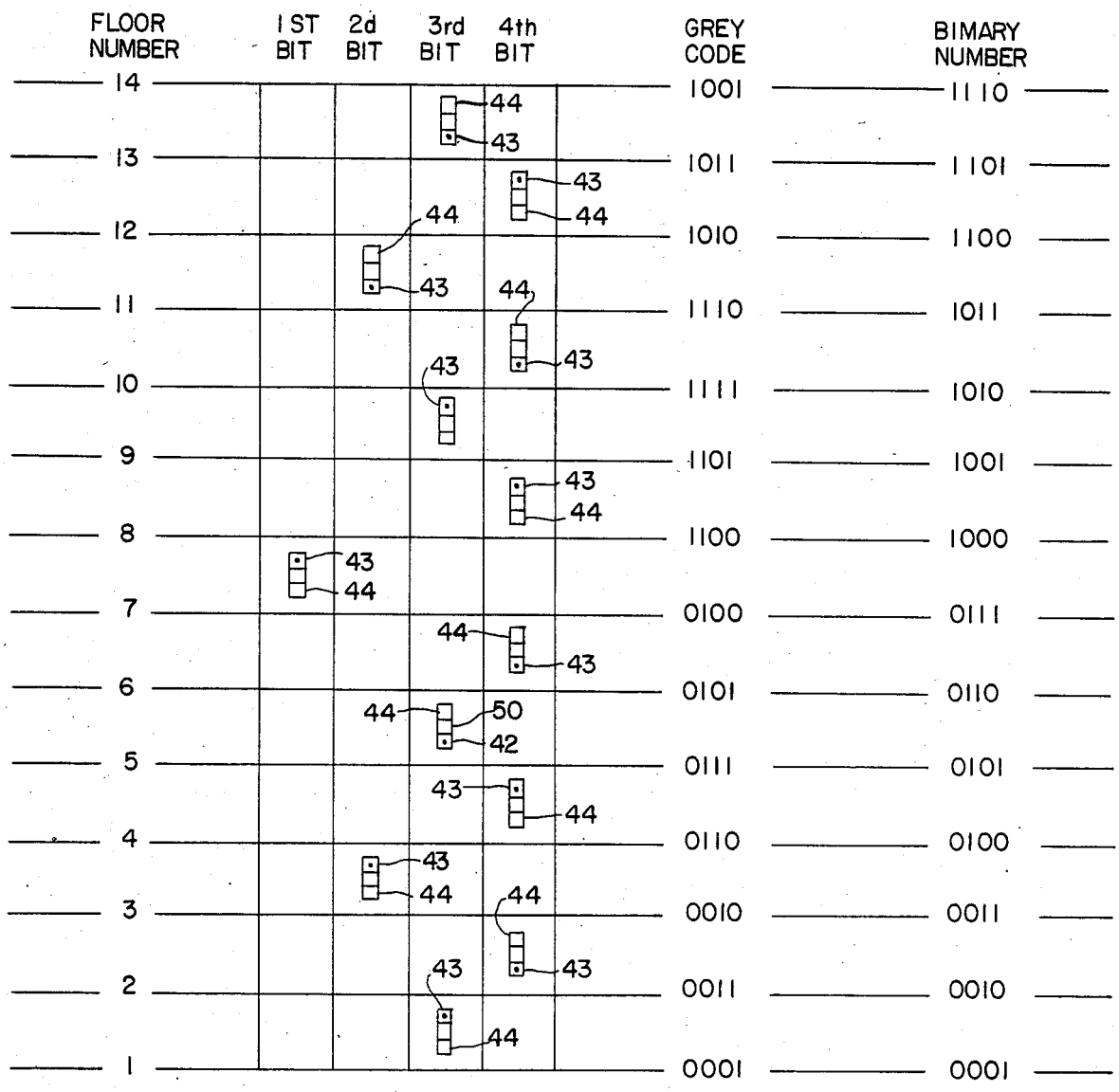
FIG. 3 shows schematically an arrangement of indicators for generating codes identifying elevator floors.

FIG. 3 shows the layout of thirteen magnets, positioned halfway between floors in a fourteen story building. Each vertical column of magnets operates a different Hall effect device, 26*a–d*, on the car. The magnets are mounted selectively with either their north pole 43 or south pole 44 at the top.

Referring to FIG. 3, as a car sitting at the fifth floor has the indicated grey code "0111". If the car moves up, the sensors 26*a–d* encounter permanent magnet 50. Magnet 50 is vertically positioned to engage only sensor 26*c*, generating the third bit of the grey code. The upwardly moving sensor 26*c* will first encounter the north pole 42 of the magnet, which will produce the output "1" for the third bit. Since the third bit is already "1", the code "0111" is left momentarily unchanged. As the car and sensor 26*c* move further up, the sensor 26*c* engages the south pole 44 of the magnet 50, which produces a "0" output in sensor 26*c*, and changes the stored field code to "0101". As shown in FIG. 3, a car reaching the sixth floor has the code "0101". For a car moving from floor six to floor "five", the magnet 50 will have the opposite effect, changing code "0101" to "0111".

This simple arrangement of permanent magnets produce a grey code (after one complete elevator trip, or at least sufficient floors to re-set each sensor element) identifying the position of the car at any point in time. Since only one digit changes per floor, only one indicator element is needed at each position. The sensing apparatus has a memory (a sort of flip-flop that is triggered to one state or other by the stationary device), that remains in one state until forced to change by the opposite type of device.

If desired, four magnets, or other indicator elements, could be positioned at each level (halfway between floors) to produce all four bits of the grey code. This would be more expensive and would not preclude the need for memory devices. One advantage of this invention, when used with indicator elements that are expensive or are difficult to install, is that only one indicator element, e.g. magnet, is required per floor, even if more sensors and lanes are added to identify a greater number of floors. For example, seven sensors would identify 127 floors, with still only one magnet required per floor.

Low power CMOS memory may be used in conjuction with a battery or capacitor to retain the memory during power interruptions. On power up, a small coil of wire in the vicinity of each Hall effect device may be used to reset the latching feature, using the code retained in the CMOS memory.

The basic theory and hardware of this invention could be employed to produce other signals and functions. For example, on a single speed traction elevator, or a hydraulic elevator, the grey code might be used to designate the slowdown points for each floor, in each direction. Six sensors can be used to produce 63 unique codes, which can designate 63 points in the hatch. Some of these points can be used to produce a position zone around each floor as outlined above, whereas other points can be used as the point of slowdown, or as door zones, etc.

The same basic hardware, without the need of a latching feature could be used to produce pulses at a particular point. For example, one sensor (not involved in the grey code) could give an "up slowdown pulse" whenever it encountered a north pole, and a "down slowdown pulse" whenever it encountered a south pole.

A microprocessor with a look-up table can assign any value to any specific grey code, not just the binary number shown in the table given in the example above. Grey code 1011, for example, could be assigned a binary number that designated the second floor, the eighth floor, or an up-slowdown point.

Figure 4A:
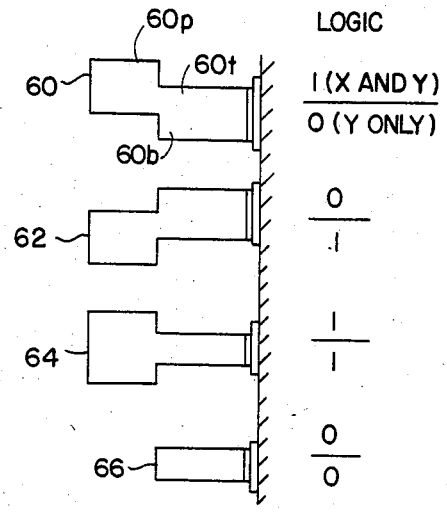
FIG. 4(*a*) illustrates several configurations of vanes, that may be used as an alternative type of indicator.
Figure 4B:
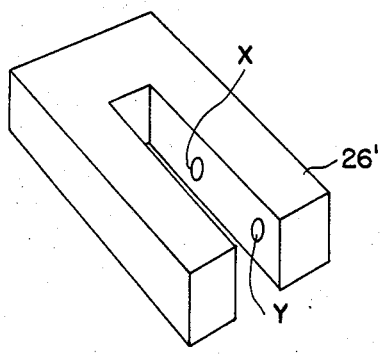
Figure 4C:
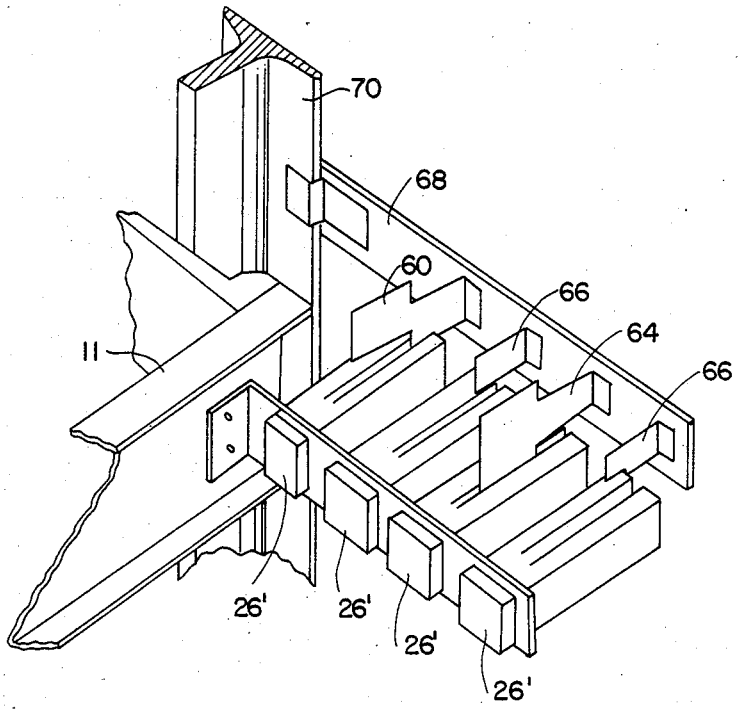

FIGS. 4*a*–4*c* illustrate a second embodiment of a sensor-indicator arrangement for producing "synchronous position" signals. As shown in FIG. 4*b*, the sensor 26′ is a dual-beam photo electric transducer, having beams X and Y. A plurality of opaque vanes, such as shown in FIGS. 4*a* and 4*c* activate the sensor.

The indicators are made up of a combination of short vanes that block beam Y only and long vanes that block both beams X and Y. In order to assure no ambiguity by the long vane blocking the Y beam an instant before the X beam, and, therefore, producing the wrong signal for an instant, the vane is shaped so that, if both the X and Y beams are to be blocked, the X beam is purposely blocked first. Vane type 60 is a long vane on the top 60*t* and a short vane on the bottom 60*b*. As shown, if a sensor approaches vane 60 from above, the X beam is blocked first by the upwardly projecting portion 60*p* of the vane top 60*t*, and thereafter both the X and Y beams are blocked by the portion 60*t*. As the sensor registers with portion 60*b*, only the Y beam is blocked. An upwardly moving sensor would encounter just the reverse. After engaging portion 60*t*, the portion 60*p* assures that the X beam remains blocked longer than the Y beam. In this way, there is no danger that the Y beam would remain blocked an instant longer than the X beam, producing an erroneous "Y beam only" signal for an upwardly moving sensor.

Vane 62 is the same as 60, but reversed. Both vanes 60 and 62 cause the output of the sensor to reverse. Vanes 64 and 66 can be used to initialize or correct the code. If vanes 64 and 66 are added to the mounting bracket along with the active vane, they will force a logic 1 or 0 output, respectively, in both directions. Vanes 60 and 62 give one output when the car is passing in the up direction, and the opposite logic output when the car passes in the down direction.

Only one active vane is required at each floor to produce the grey code, but since the vanes are such simple, economical components, it would be practical to install vanes in all positions at all floors to gain the checking function. FIG. 4*c* shows one active vane 60 and three inactive vanes 64, 66, used with an array of four sensors 26′ mounted to the frame 11 of the car. The vanes 60, 64, 66 are secured to a mounting bracket 68 attached to a rail 70 in the hatch. Vane 60 produces the logic "1" when the sensors 26′ move past vane 60 in the upward direction (see FIG. 4*a*) and logic "0" when sensor 26′ is moving down. Vane 64 produces a logic "1", and vanes 66 produce a logic "0", in either direction of movement. Accordingly, when the car moves up, the 4-bit grey code "0101" is produced. When the car moves down, the code "0100" is produced. As noted above, vanes 64 and 66 can be eliminated if desired, since they act only to correct a code which is in error due to power interruption or spurious noise. Many different types of sensors and indicator devices may be used as well.

Control of Car Operation

The microprocessor-based selector 20 sets a number of parameters to control car movement. "Target floor" is the next floor at which the car could stop from its present position, based on its present velocity and position. When the elevator starts a run, the target floor is the next adjacent floor in the direction of movement of the car. When the car is moving at a faster speed, the target floor may be several floors ahead of the next approaching floor. The target floor is, in the present control system, the same as the "advanced position" of the car.

The microprocessor also contains the value of "target distance", which is the distance, measured in pulse increments (e.g. 0.5 inch), from the car to the target floor.

Absolute position is a signal produced from the combination of synchronous position and the "car level" signal. While this signal is being produced, the absolute position of the car is known within one half inch without resorting to calculation or memory. While the car is stopped level with a building landing, the absolute position signal is continuous, whereas it will be a short duration pulse as the car passes a landing level while in motion.

Floor height is the distance between adjacent floors, in units of pulse increments. For example, if the vertical distance from the fourth to fifth floor in a building is 11 feet, seven inches, this distance is stored in memory as 278 half inch increments.

The selector outputs the synchronous and the advance car position signals to the elevator control for use in direction selection circuits, to determine equivalency of advance car position with registered calls, to cancel answered calls, and to operate various audible and visual signals. The selector also produces the velocity versus position signal for the elevator speed control section, as described further on.

Acceleration and Deceleration Tables

While an elevator is being installed, the desired rate of acceleration, the contract speed, the desired rate of deceleration, the desired rate of acceleration change (jerk), and the landing speed are fed into the microprocessor, which uses these data in a program to generate "look-up tables" for desired acceleration and deceleration of the elevator. Programs for generating these tables are described further on.

The acceleration tables contain the desired velocity at specified time intervals during acceleration of the car to top speed. The velocities are calculated using the set rate of acceleration (4 ft./sec.$^2$, for example) and the selected rate of change of acceleration (jerk), for example, 8 ft./sec.$^3$, to give the ideal velocity at specified time intervals (every 1/32 of a second, for example).

The deceleration look-up table is a table of ideal velocities, referenced by specific distances instead of time periods. It includes a set landing speed, and may be based on a deceleration rate that is different from the acceleration rate.

The microprocessor also has a program to calculate the critical position for advancing the selector, and to calculate the velocity profile on a run where the elevator is unable to attain rated speed.

Operation

Figure 5:
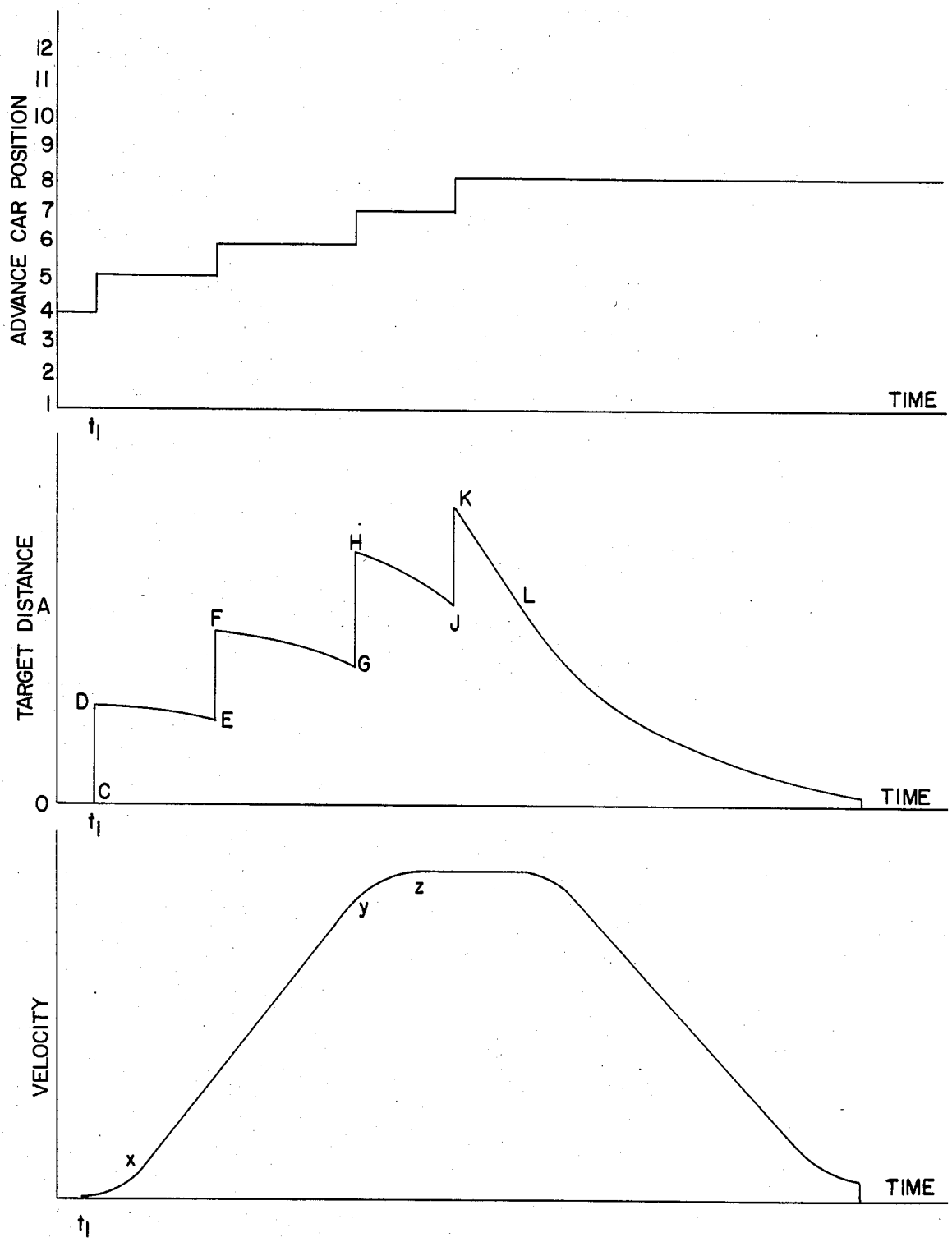
FIGS. 5 and 6 are graphs illustrating the operation of an elevator system in accordance with the invention on a typical car run.

The present system is intended for elevators whose top speed is great enough that the car cannot attain full speed when traveling between adjacent floors. FIG. 5 depicts the operation of a car that is sitting level at the fourth floor and receives an eighth floor call. FIG. 13 illustrates a sample control program for controlling the run.

The multi-bit code indicating the fourth floor (synchronous position) is stored in memory. A conventional direction selection circuit can be used to determine that the car must go "up" to answer the call. At the instant the car starts up (at time T1), the digital number representing the distance between the fourth and fifth floor (line CD), is loaded from memory into a target distance (TD) register, and the advance car position (target floor) steps to five.

As the car begins to move, a pulse is generated by pulse generator 22 (FIG. 1) every ½ inch of travel. The number in the target distance register is decremented by each pulse.

At the end of each selected time interval (e.g. 1/32 second) the microprocessor outputs to the speed control section 18 (see FIG. 1) the desired velocity, from the acceleration look-up table. After about two inches of motion (Point X on FIG. 5) the pattern will have attained the set rate of acceleration. The time it takes to reach constant acceleration can easily be calculated, as described further on.

Once the car has reached constant acceleration, the microprocessor begins to determine whether the car is at a critical stopping distance relative to the target floor. This calculation, described later, is a function of velocity and the selected rates of jerk, deceleration, and landing speed. This calculation is done periodically, for example each 1/32 of a second. The instant where critical stopping distance is reached, the car must either begin slowdown, or the advance position must advance one floor.

In the example, at the time the car reaches the critical stopping point for the fifth floor, Point E, there is no call registered for floor five. There being no need to stop at the fifth floor, when the critical distance is reached at Point E, the floor height from five to six is added to the target distance (line EF) and the advanced car position is advanced to the sixth floor. The microprocessor continues to calculate the critical stopping distances at each velocity, until the velocity reaches Point Y, which is the end of constant acceleration.

At Point Y, no more calculations of stopping distance are necessary. Between Y and Z, no calculations are done because the acceleration is being reduced at a jerk rate equal to that which would occur during stopping. After Point Z, when the car is at top speed, no calculation is required because the slowdown distance is constant (OA on FIG. 5). When the car is at rated speed, the advance car position will advance one floor each time the target distance reduces to value OA.

Once the selector advances to the eighth floor (where a call is registered) it will not advance again, and slowdown will commence at Point L.

During slowdown, the target distance will continue to be decremented by the pulses received from the pulse generator 22. At set time intervals, the microprocessor outputs ideal velocities from the look-up table, based upon target distance, to the speed control section, to correct motor speed. When the Target Distance reading indicates that the car is within the desired stopping distance of the landing, the final stop at the floor is controlled by the leveling device on the car and a stationary vane in the hatch (as is conventional).

When the car stops at a floor, the synchronous position, the absolute position and the advance position are all the same. Target distance is zero.

Correction of Target Distance

The absolute or "car level" position signal is generated whenever the car is within ±½ inch of a floor level.

Whenever the car is in motion and an absolute position signal is generated, the microprocessor recalculates instantaneous target distance by adding the floor heights (from memory) between the absolute car position and the advance car position. This sum replaces the stored value in the register containing target distance. This will correct any errors in target distance caused by ramdom noise, rope slippage, or rollback on starting.

Express Zones

The mid-rise and high rise group of elevators in a building normally have an express zone of floors that are not served by those elevators. It is often 15 to 30 floors of express travel. The microprocessor handles express zones as follows:

(a) It arbitrarily sets several dummy floors at each end of the express zone. The floor heights of the dummy floors are any convenient distance such as 12 or 15 feet. Enough dummy floors are added to cover the maximum slowdown distance for the rated speed. For example, one dummy floor would suffice for a 500 FPM elevator having 10–12 feet of slowdown. Three dummy floors would be required to cover 40–45 feet of slowdown for a 1000 FPM elevator.

(b) Grey code devices are installed between dummy floors just as though they were landings served.

(c) The express zone is then defined as the distance between the highest dummy floor at the bottom end and the lowest dummy floor at the top end of the blind hatchway.

(d) The floor height memory would record the "express zone" floor height as zero feet.

(e) Whenever the "synchronous position" indicated the express zone, the target distance is not decremented by incremental pulses.

(f) Hall lantern operation and call cancelling would be delayed until slowdown commenced.

Power Up Procedure after Power Interruption

If the car is level with the floor, the absolute position is available and the selector can begin to function immediately (after several bookkeeping chores like transferring floor heights from ROM to RAM).

If the car is between floors on power up, a slightly modified program will control operation. The synchronous position indicates the closest floor only, and the car will not answer a call at the floor it is sitting closest to. However, it will start and run in the correct direction when receiving a call from any other floor.

The selector sets an initial Target Distance sufficient to stop the car in a worst case situation, that is, when it is just away from the floor landing. Assuming it takes the car as long to accelerate as to stop, initial target distance may equal half the floor height to the next approaching floor. No decrementing of target distance or calculation of stopping distance will occur until either a synchronous position signal is received (i.e., a digit of the grey code changes) or a car level signal is received. If a synchronous position signal is received first, it indicates that the car is halfway between floors, and the target distance therefore represents actual distance. In a worst case situation, the car will have just enough distance to stop if a call is registered at the next floor. If a car level signal is received first, the selector recalculates actual target distance. Thereafter, the selector functions normally.

Correction of Floor Heights

If desired, the microprocessor can include a digital counter subroutine, programmmed to count incremental pulses and to be reset to zero each time an absolute position pulse is received. This counter would therefore measure floor heights in increments. Its count, just prior to being reset, may then be used to correct the floor height memory in RAM. The microprocessor subroutine can run intermittently or continuously.

LOOK-UP TABLE CALCULATIONS

The programs to calculate the look-up tables are based on well known formulae and physical relationships between distance, velocity, acceleration and time.

Figure 6:
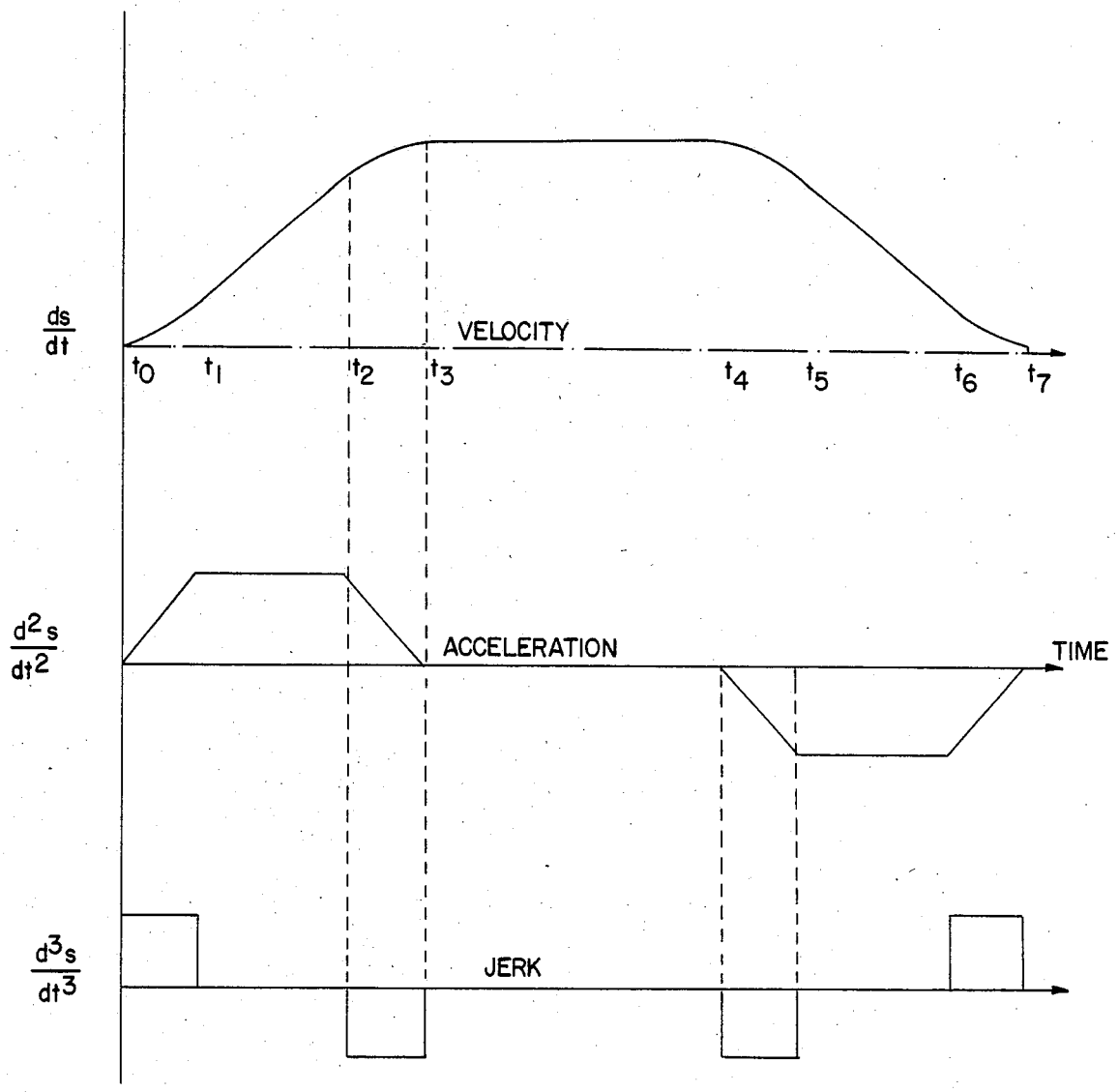

FIG. 6 shows an ideal speed profile of a body moving under constraints on the first, second, and third derivative of distance with respect to time. During the period from $t_0$ to $t_1$, the jerk is at a constant selected positive value, which causes the acceleration to increase linearly. The velocity follows a parabolic curve. From $t_1$ to $t_2$, the jerk is zero, the acceleration is a constant positive value, and the velocity increases linearly. From $t_2$, to $t_3$, the jerk is a constant negative value, which causes the acceleration to reduce linearly and the velocity to follow a parabolic curve. From $t_3$ to $t_4$, the jerk and acceleration are zero, and the velocity remains constant. During period $t_4$, to $t_5$, the constant negative jerk causes the acceleration to increase linearly in a negative direction (i.e. deceleration). Finally, there follows a period of constant deceleration ($t_5$–$t_6$) and a period of reducing deceleration ($t_6$–$t_7$).

The time based acceleration profile, or look-up table, is generated as follows, referring to FIG. 7. The period $t_0$ to $t_1$ is the time required to increase the acceleration linearly from 0 to "a" with jerk of "J" ft./sec.$^3$. The microprocessor is set to calculate the changes in acceleration and velocity by considering short-time periods $\Delta t$. The number of calculations (n) during this $t_0$ to $t_1$ period is therefore:

$$n = \frac{a/J}{\Delta t} = \frac{a}{J\Delta t}$$

The acceleration at $t_1$ must be "a". Since it increases linearly, at the rate "J", the change in acceleration $\Delta a$ during each $\Delta t$ period will then be:

$$\Delta a = J\Delta t$$

The change in acceleration is independent of the set rate of acceleration, but depends only on the set value of jerk and the time period $\Delta t$ under consideration.

Let $a_1, a_2, a_3, \ldots a_n$ be the average rate of acceleration in each successive $\Delta t$ period. In the first period $\Delta t$, the acceleration at the beginning is zero and at the end is $\Delta a$.

$$a_1 = \frac{O + \Delta a}{2} = \frac{\Delta a}{2}$$

The average acceleration of each successive $\Delta t$ period is $\Delta a$ greater than the previous period.

$$a_2 = a_1 + \Delta a$$

$$a_3 = a_2 + \Delta a$$

$$\vdots$$

$$a_n = a_{n-1} + \Delta a$$

The velocity at the end of a $\Delta t$ period is the velocity at the beginning of the period plus the average acceleration multiplied by the time period, $\Delta t$.

$$v_1 = v_0 + a_1 \Delta t \; (v_0 = 0)$$

$$v_2 = v_1 + a_2 \Delta t$$

$$\vdots$$

$$v_n = v_{n-1} + a_n \Delta t$$

Multiplying a digital number by $\frac{1}{2}^x$ only requires shifting the number "X" places to the right (equivalent to dividing by 10 or 100 in base 10). Therefore, it is convenient to select $\Delta t$ as a period such as $\frac{1}{2}^x$ seconds where x is an integer, t=1/16 or 1/32 or 1/64, etc. The program to calculate successive velocities is therefore very simple.

In accordance with these formulas, the microprocessor calculates ideal velocity for each $\Delta t$ in the time period t=0 to t=a/J, the time to reach constant acceleration. Next, the program determines the values of the look-up table during the time of constant acceleration. Before doing so, it is necessary to identify $V_{t2}$, the end of the constant acceleration portion of the curve.

The length of the period $t_2$ to $t_3$ is the same as the period $t_0$ to $t_1$, i.e. a/J seconds. During this period, the acceleration decreases linearly from "a" to zero and, therefore, the average acceleration is a/2.

The velocity at time $t_2$ is related to the velocity at $t_3$ by the formula:

$$V_{t3} = V_{t2} + at$$

$$= V_{t2} + \left(\frac{a}{2}\right)\left(\frac{a}{J}\right)$$

$$= V_{t2} + \frac{a^2}{2J}$$

where $Vt_3$ is the rated maximum velocity of the elevator (contract speed), and $Vt_2$ is the velocity at the end of the constant acceleration period.

$$V_{t2} = \text{rated speed} = \frac{a^2}{2J}$$

During the period $t_1$ to $t_2$, when the acceleration is constant, each succeeding velocity is $\Delta V$ greater than the last, where $\Delta V = a \cdot \Delta t$. The program continues calculating velocities $\Delta V$ greater than the previous one until the velocity$=V(\text{rated}) - a^2 2J$. In this way, the microprocessor builds the velocity vs. time look-up table up to point $t_2$. For velocity calculations during the period $t_2$–$t_3$, when the acceleration is decreasing linearly from "a" to zero.

Time $t_2-t_3=a/j$ seconds

The number "n" of Δt periods is:

$$n = \frac{a/J}{\Delta t} = \frac{a}{J\Delta t}$$

The change in acceleration (Δa) during Δt is:

$$\Delta a = J\Delta t$$

The acceleration at the beginning of the first Δt period is "a" and at the end of the period is (a−Δa). The average acceleration during the period is:

$$a_1 = \frac{a + (a - \Delta a)}{2} = a - \frac{\Delta a}{2}$$

Each successive average acceleration is Δa less than the previous one:

$$a_2 = a_1 - \Delta a$$

.

.

.

$$a_n = a_{n-1} - \Delta a$$

The velocities at the end of each Δt time period can therefore be calculated from the formula:

$$V_1 = V_0 + a_1 \Delta t, \text{ where } V_0 = V_{l2}$$

$$V_2 = V_1 + a_2 \Delta t$$

.

.

.

$$V_n = \text{contract speed} = V_{n-1} + a_n \Delta t$$

Based on the foregoing, it is relatively straightforward to write a program to take set values of "a", J, and maximum velocity and calculate a look-up table of velocity versus time based on constant intervals of time, Δt.

Deceleration

Figure 9:
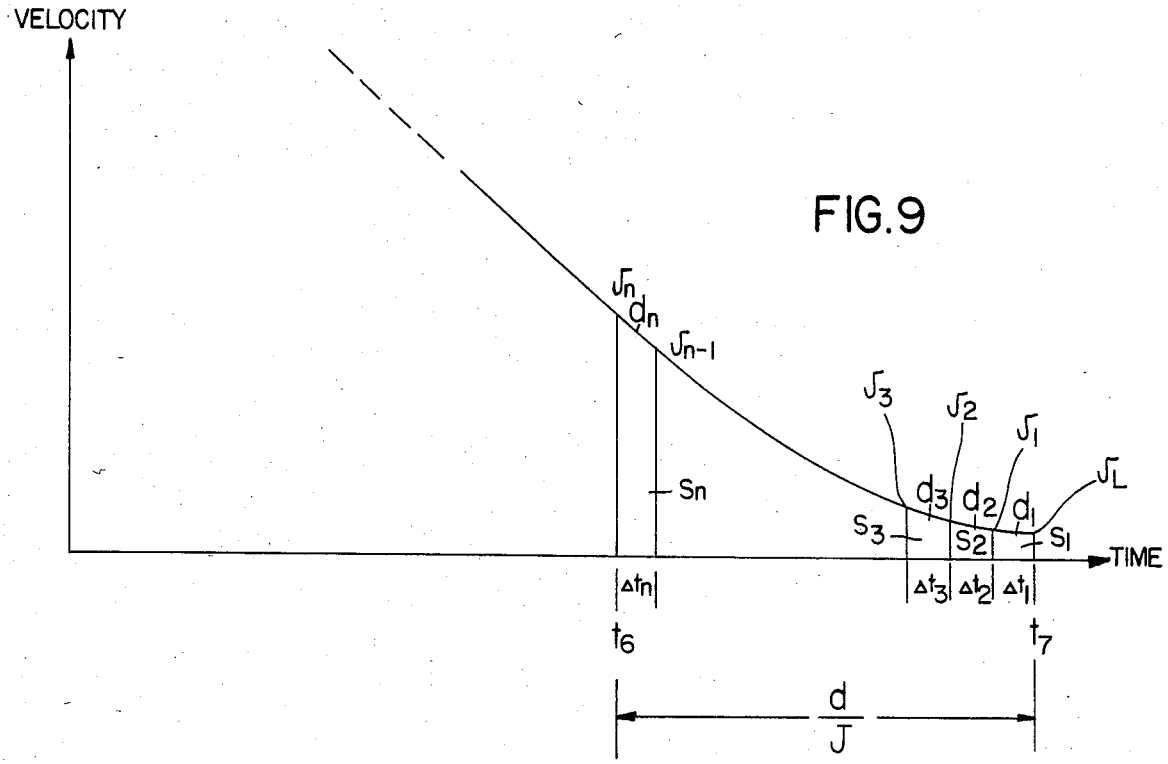
FIGS. 9 and 10 are graphs illustrating a computer-based generation of a deceleration table in accordance with the invention.

The look-up tables for deceleration are based on distance and, therefore, a different calculation method is used. The calculation is best accomplished by a program working backwards from stop, through slowdown to top speed. Refer to FIG. 9. Velocity $V_L$ is the landing speed set by the mechanic during adjustment of the elevator. The set value of deceleration will be called "d", since it can be different from the acceleration value "a". A different value of jerk could be used, but there is no reason to do so.

As before, the acceleration must change by Δd during each period Δt, where $$\Delta d = J\Delta t$$

The average acceleration during the first period $\Delta t_1$ is $$d_1 = \frac{\Delta d}{2}$$

As before $$d_2 = d_1 + \Delta d$$

$$d_3 = d_2 + \Delta d$$

.

.

.

$$d_n = d_{n-1} + \Delta d$$

The velocity for each time period t=0 to t=n, the period of final slowdown, is calculated as follows:

$$V_1 = V_L + d_1 \Delta t, \text{ where } V_L = \text{landing speed}$$

$$V_2 + V_1 + d_2 \Delta t$$

.

.

.

$$V_n = V_{n-1} + d_n \Delta t$$

The area under a velocity versus time plot is equal to the distance traveled. Therefore, the distance traveled during the first Δt period is:

$$S_1 = \frac{V_L + V_1}{2} \cdot \Delta t$$

and thereafter $$S_2 = \frac{V_1 + V_2}{2} \Delta t$$

The microprocessor can make calculations based on very short Δt periods, and add the areas (distances) together. The look-up table could be constructed to record the velocity at each point where the distance was a multiple of the pulse distance. This would take a lot of memory, and would give too many points at high speed, with very small changes in velocity. A preferred method would be to record the distance and velocity at equal time periods. For example, a table entry could be made after every four Δt periods. Therefore, the distance S would be:

$$S = S_1 + S_2 + S_3 + S_4$$

Velocity would be $V_4$. The next distance would be the sum of $S_1+S_2+S_3$- - - $S_8$ and the velocity would be $V_8$. This reiteration will continue until the deceleration rate becomes "d".

During the time period $t_5$ to $t_6$, (as shown on FIG. 6) the velocity changes linearly with time. The value Δv is a constant and each calculated velocity is Δv greater than the previous one. The distance traveled is still the average velocity multiplied by Δt. It is only necessary to calculate the velocity at time $t_5$ to recognize the end of the linear portion.

As before, the time $t_4$ to $t_5$ is d/J and the average deceleration for this period is d/2. Therefore, the velocity at $t_5$ is:

$$V_{t5} = \text{rated speed} - \frac{d^2}{2J}$$

Figure 10:
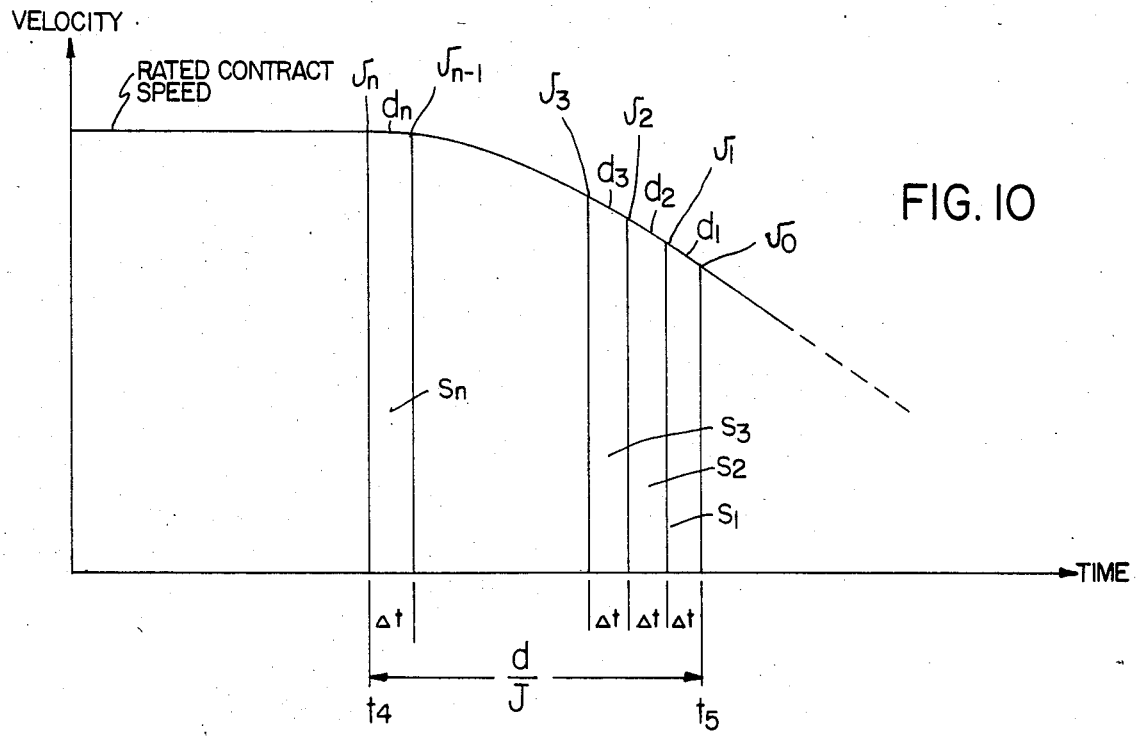
Figure 13A:
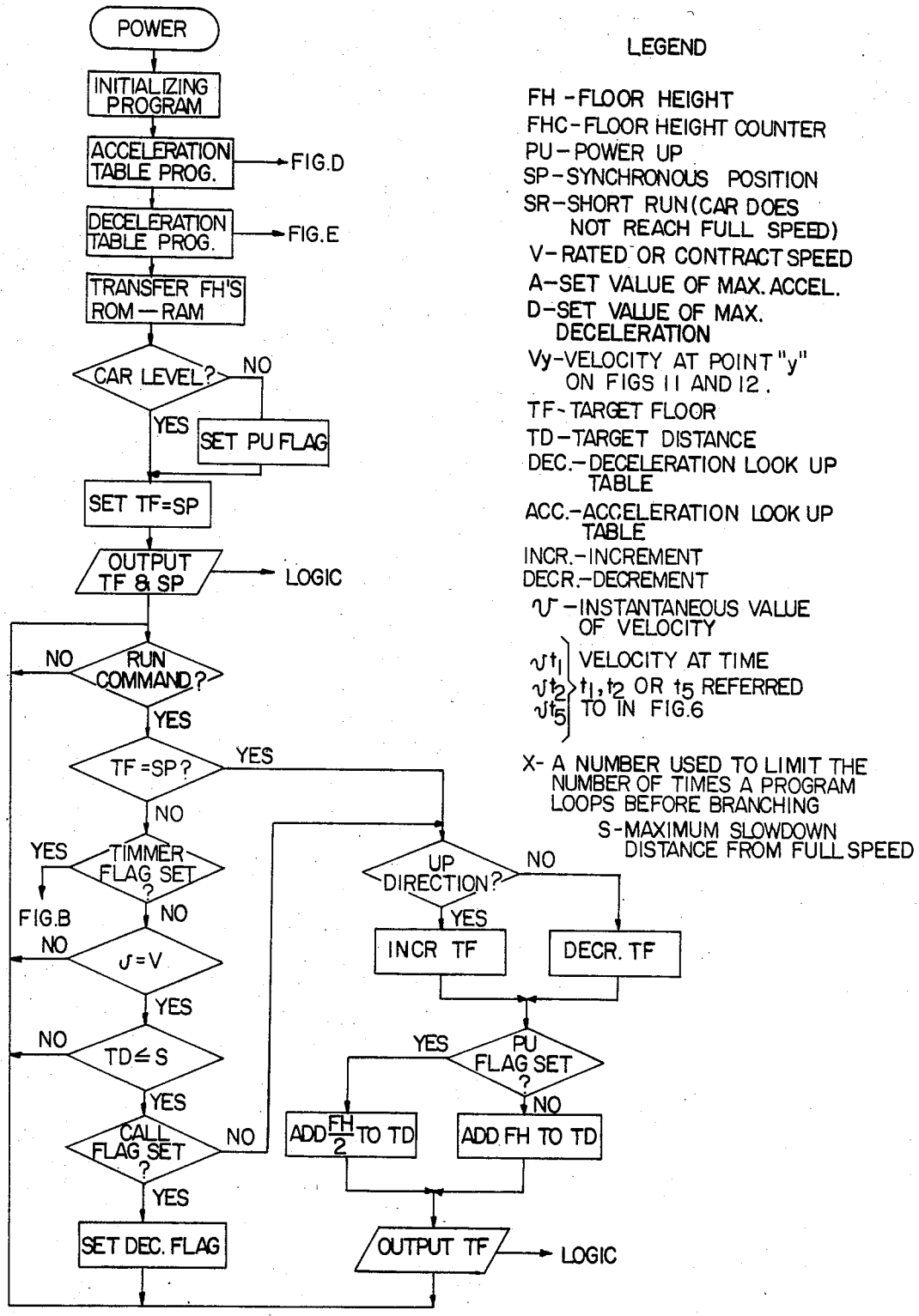
FIGS. 13*a–b* are flow diagrams for a preferred control program for elevator operation.
Figure 13B:
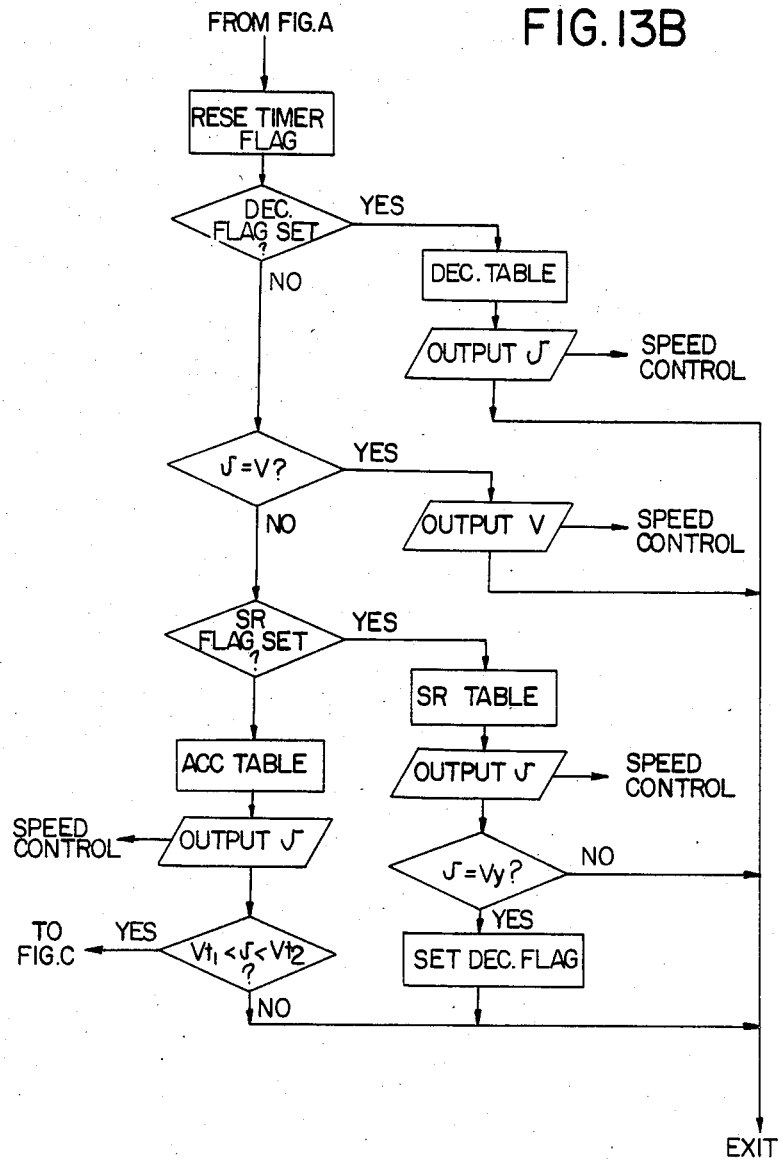
Figure 13C:
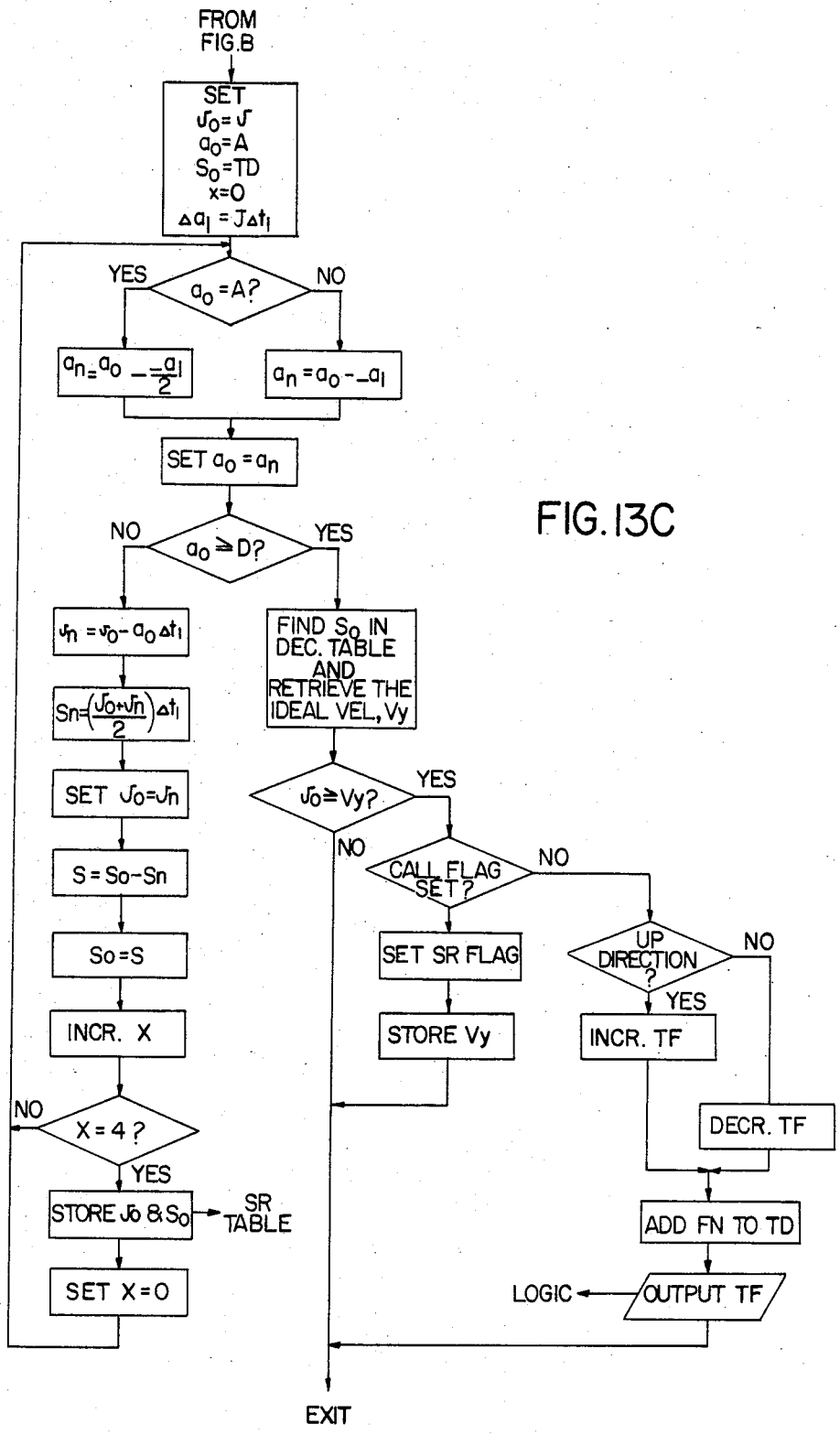
Figure 13D:
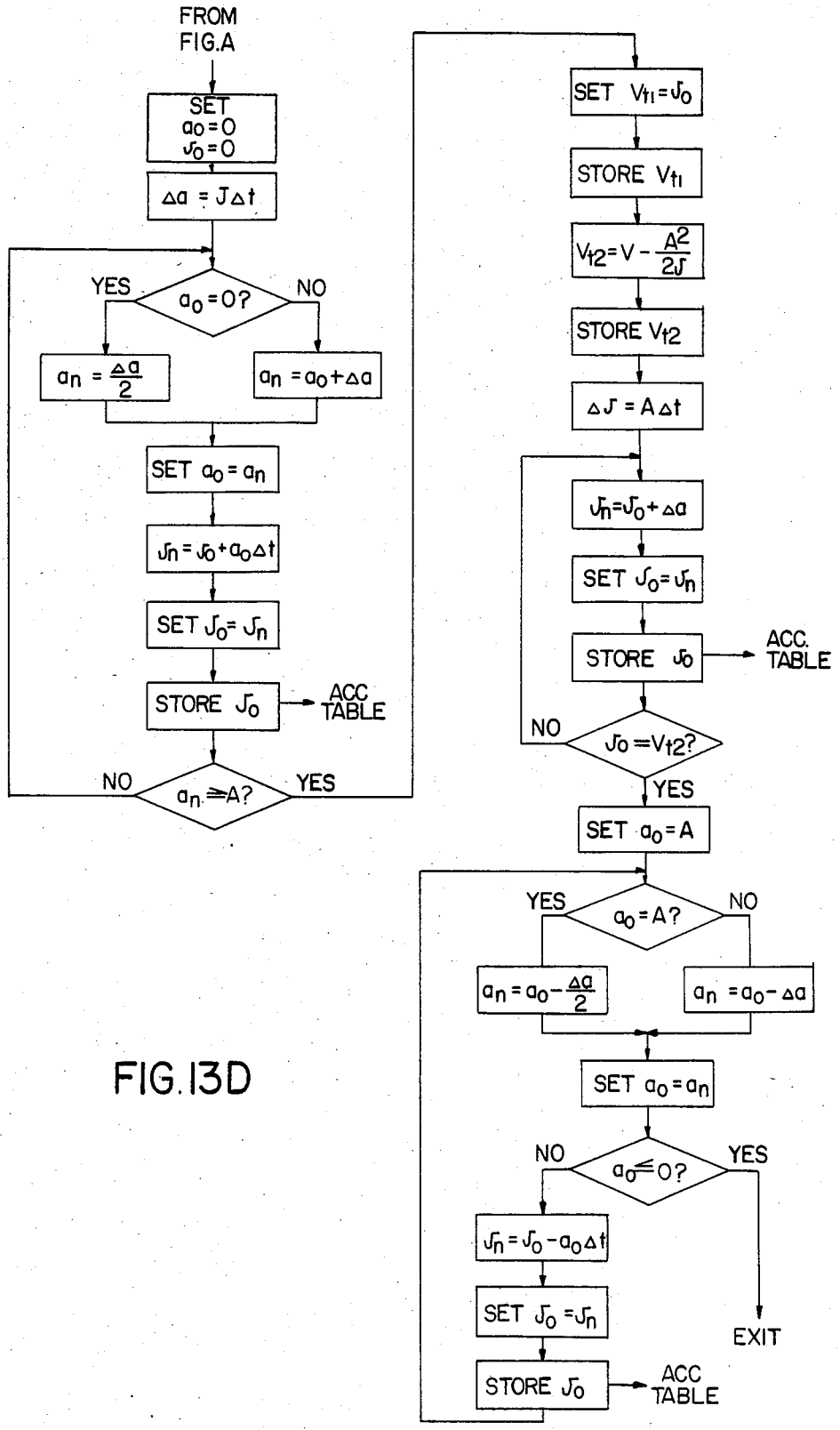
Figure 13E:
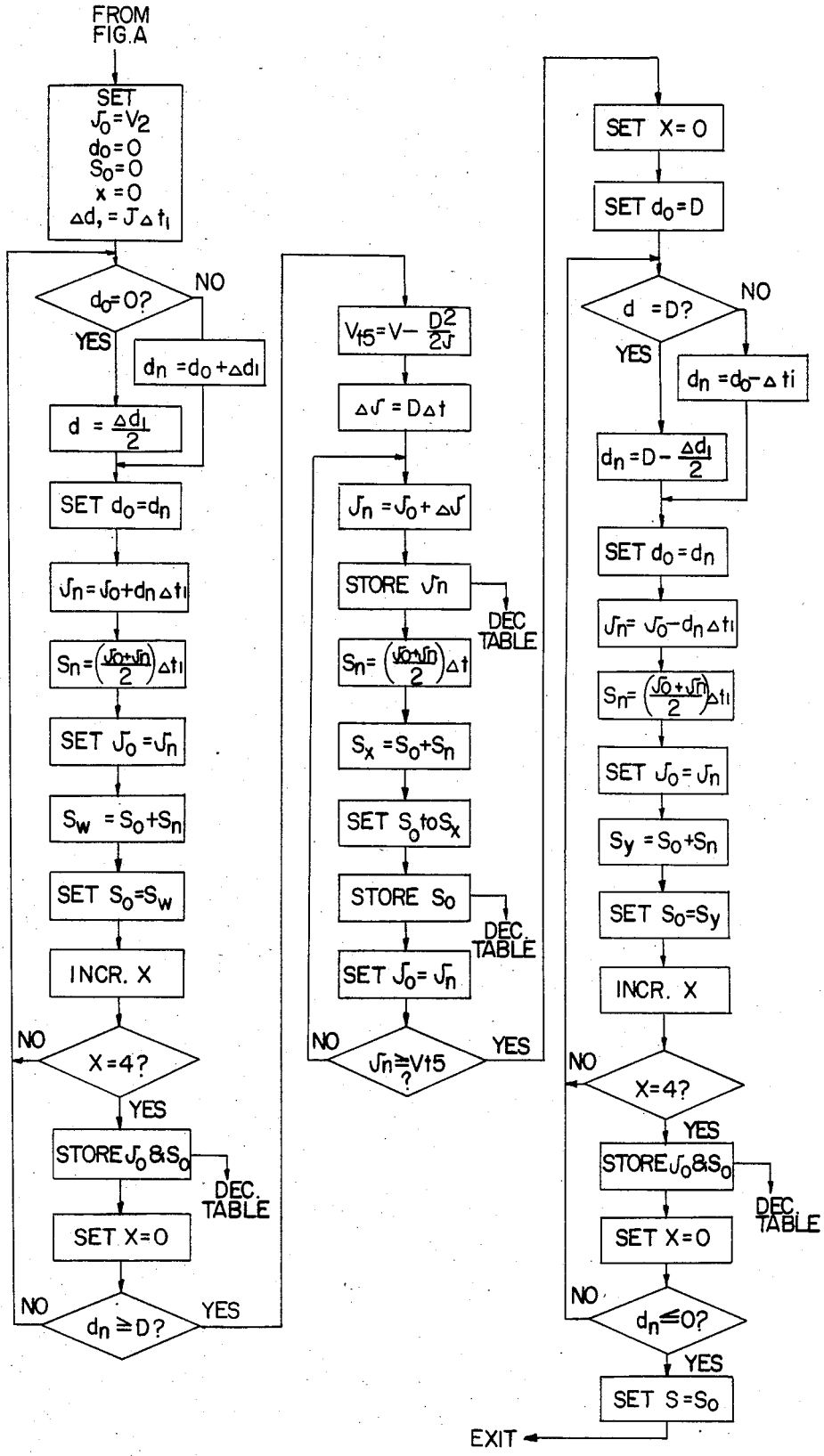
Figure 13F:
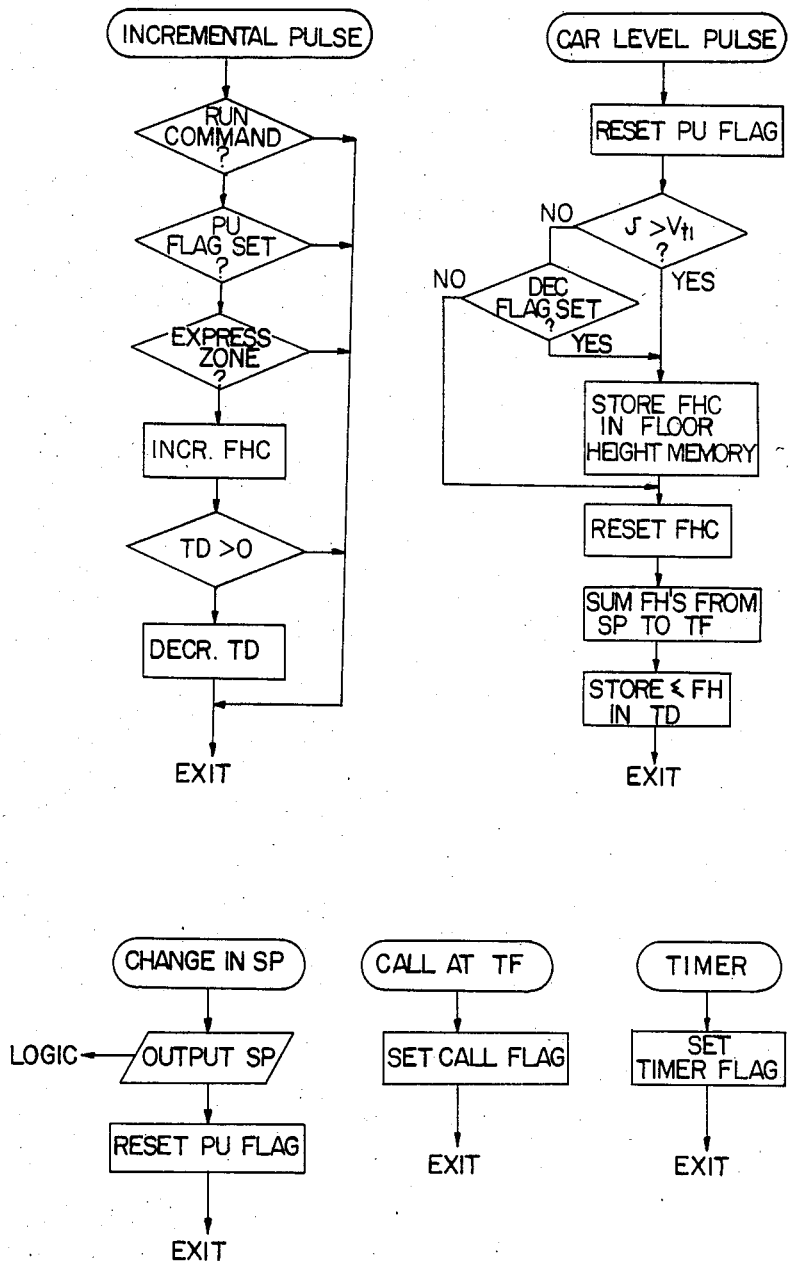

Once this velocity is reached, the program jumps to one for calculating the period $t_4$ to $t_5$, the build-up of deceleration. Refer to FIG. 10 for the build-up of deceleration from zero, at full speed, to the set rate of "d". Once again, the calculation is done from right to left on the diagram (backwards in time).

The procedure is similar to that described in connection with FIG. 8, except that the extra step to calculate the area under the curve is included. That is:

$$d_1 = d - \frac{\Delta d}{2}$$

$$d_2 = d_1 - \Delta d$$

.

.

.

$$d_n = d_{n-1} - \Delta d$$

and $$V_1 = V_0 + d_1 \Delta t$$

$$V_2 = V_1 + d_2 \Delta t$$

.

.

.

$$V_n = V_{n-1} + d_n \Delta t$$

and therefore:

$$S_1 = \frac{V_0 + V_1}{2} \cdot \Delta t$$

$$S_2 = \frac{V_1 + V_2}{2} \cdot \Delta t$$

.

.

.

$$S_n = \frac{V_n + V_{n-1}}{2} \cdot \Delta t$$

In this way the microprocessor builds up a table of velocities and distances that designate, to any desired degree of accuracy, a distance-based velocity profile determined by the set restraints of deceleration, jerk, and final velocity (landing speed).

For any value of target distance, the microprocessor can output the ideal velocity to the elevator speed control, and does so to control elevator slowdown.

Stopping Decision

The look-up tables give the time-based acceleration, and the distance-based deceleration values of velocity for an elevator which travels far enough to reach full speed before beginning to decelerate. In many elevator runs, the car does not reach rated speed. The selector, therefore, during acceleration needs to calculate the critical point for advancing the selector (if no stop call is registered at a target floor), and to produce a distance-based velocity profile to control elevator slowdown, for runs where the car never reaches top speed.

FIG. 11 shows the velocity profile for two elevator trips, one in which the car accelerates to full rated speed, and one for a shorter trip, where the car does not reach full speed.

At each successive point X, which is based on Δt, on the linear acceleration portion of the curve, the microprocessor calculates the distance required to bring the car to a stop from that particular velocity, under the stated constraints of jerk, deceleration, and landing speed.

FIG. 12 is the shaded area of FIG. 11. At point X on the linear portion, the car has velocity $V_X$, which can be determined from the acceleration look-up table.

As previously discussed;

$$a_1 = a - \frac{\Delta a}{2}$$

$$a_2 = a_1 - \Delta a$$

.

.

.

$$a_n = a_{n-1} - \Delta a, \text{ where } \Delta a = J\Delta t \text{ and } n = \frac{a}{J\Delta t}$$

And:

$$V_1 = V_x + a_1 \Delta t$$

$$V_2 = V_1 + a_2 \Delta t$$

.

.

.

$$V_n = V_{n-1} + a_n \Delta t$$

And:

$$S_1 = \frac{V_x + V_1}{2} \Delta t$$

$$S_2 = \frac{V_1 + V_2}{2} \Delta t$$

.

.

.

$$S_n = \frac{V_{n-1} + V_n}{2} \Delta t$$

As noted before, Δa depends only on the values chosen for J and Δt, and not on the maximum value of acceleration or deceleration.

This calculation can therefore progress until the acceleration has been reduced from 37 a" to "d".

The calculated increments of distance are progressively subtracted from the target distance. A new look-up table is generated with values of target distance and velocity. The last velocity recorded in the table is $V_n$, at a target distance, D, where D = target distance at point x $\bar{\bar{\bigcirc}}$ $S_1$–$S_2$– . . . $S_n$ $TD_X$ is the target distance at the point "X" under consideration.

The look-up table for deceleration is now consulted to find the ideal velocity at a target distance of "D". If the ideal velocity is greater than $V_n$, the car is allowed to continue accelerating. The previous calculation, outlined above, is repeated for the next value of $V_X$, and the new look-up table is recorded in the same block of memory as before. This calculation procedure, and comparison of ideal velocity to $V_n$, continues until Ideal velocity $\leqq V_n$ This is the critical point. The selector must advance if no call exists at the target floor, or the car must begin to slow down.

If slowdown is to commence, the microprocessor begins using the new look-up table to output the velocity profile from point X to point Y on FIG. 11, to the speed control section. When the target distance reaches distance "D", it then jumps to "D" in the deceleration look-up table (which is also $V_n$). It follows the entries in the deceleration table as the target distance is decremented by the distance pulses, outputing the ideal velocities to the speed control section of the motor.

If no call exists at the target floor when the target distance becomes critical, there is no need to slow down. The advance position is advanced one floor and that floor height is added to the target distance. The car is allowed to continue accelerating and the program to check critical target distance continuous as before.

FIG. 13 sets forth an exemplary flow chart for a control program as described above.

The foregoing represents preferred embodiments of the invention. Variations and modifications of the structure and methods described therein will be apparent to persons skilled in the art, without departing from the inventive principles disclosed herein. All such modifications and variations are intended to be within the scope of the invention as defined in the following claims.

I claim:

1. In an elevator having a car, motor means for displacing said car between a plurality of floors, speed control means for controlling said motor means, and means for generating call signals for said floors, a digital selector system comprising:

means for storing, as absolute values, distances between adjacent floors;

means for storing a deceleration look-up table of ideal stopping velocities, at a plurality of stopping target distances, based upon selected values of jerk, deceleration, and landing speed;

means for generating, at a plurality of fixed reference positions, position signals representative of instantaneous car position;

means for selecting an initial target floor as the next adjacent floor in the desired direction of car travel, and for determining target distance from the distance storing means;

pulse generating means responsive to car movement for producing pulse signals representing incremental distances of car travel;

means for decrementing the target distance responsive to the generation of each pulse signal for generating instantaneous target distance;

means for periodically determining instantaneous car velocity;

means for periodically calculating the car slowdown distance, based on instantaneous car velocity, for decelerating the car, at said selected rate of jerk, to said selected value of deceleration, for calculating a slowdown table of ideal car velocities versus distances for such car slowdown, and for calculating slowdown car velocity when selected deceleration is reached;

means for subtracting car slowdown distance from instantaneous target distance to determine stopping target distance;

means for comparing ideal stopping velocity, taken from said deceleration look-up table based on stopping target distance, with said slowdown car velocity value for determining critical car distances for making stopping decisions;

means responsive to a determination that the car has not reached a critical car distance, for recalculating car slowdown distances, slowdown tables, and car slowdown velocities, based upon updated instantaneous car velocities, and for comparing slowdown velocities with ideal stopping velocities, determined from updated instantaneous target distances, until a critical car distance is reached;

means responsive to absence of a call signal at a target floor, at critical car distance, for advancing target floor to the next adjacent floor and for adding to the instantaneous target distance the distance to the new target floor; and means responsive to the receipt of a call signal at a target floor, at a critical car distance, for issuing a stop signal to said speed control means and for periodically outputting ideal velocities from said slowdown table and said deceleration table, for issuing correction signals of car velocity, as a function of instantaneous target distances, to said speed control means.

2. An elevator as defined in claim 1, wherein the means for determining values of car velocity includes means for storing an acceleration table containing values of ideal velocity at selected time intervals, up to a selected maximum car speed, and wherein said selector includes means outputting signals representative of ideal velocities as speed correction signals to said speed control means.

3. An elevator as defined in claim 2, wherein the selector further includes means responsive to the generation of each position signal for correcting instantaneous target distance.

4. An elevator as defined in claim 3, wherein the means for generating position signals includes synchronous positioning means having at least one stationary member between floors, and sensor means on said car for generating signals indicative of the next approaching floor, and instantaneous position signal means for indicating when the car is level with a floor.

5. An elevator as defined in claim 4, wherein said synchronous position indicating means includes means for generating a grey code series of numbers identifying respective floors, wherein sensor elements are provided between each floor for changing only one digit of a grey code sequence.

6. An elevator as defined in claim 5, wherein said sensor elements are magnets, and said sensor elements comprise a plurality of horizontally arranged sensors on said car.

7. An elevator as defined in claim 5, wherein said indicator elements comprise vanes, and said sensor elements comprise a plurality of horizontally arranged sensors on said car.

8. An elevator as defined in claim 4, wherein said elevator includes an express zone, and wherein the means for generating position-signals includes stationary members near each end of said express zone for providing at least one dummy floor to enable sufficient slowdown distance.

9. An elevator as defined in claim 4, wherein said selector system includes means for counting pulses between instantaneous position signals for correcting the stored values of distances between floors.

10. A method of operating an elevator having a car, motor means for moving the car between floors, speed control means for controlling said motor means, and means to generate call signals for said floors, comprising the steps of:

storing, as absolute values, distances between adjacent floors;

storing a deceleration look-up table of ideal stopping velocities, at a plurality of stopping distances, based upon selected values of jerk, deceleration, and landing speed;

generating, responsive to car movement, at a plurality of fixed reference positions, position signals representative of instantaneous car position;

selecting, at initiation of a car run, an initial target floor as the next-adjacent floor in the desired direction of car travel and determining target distance from the stored distance values;

providing a pulse generating means for producing pulse signals, responsive to car movement, representative of incremental distances of car travel;

decrementing target distance responsive to generation of each pulse signal to generate instantaneous target distance;

periodically determining car velocity;

periodically calcuating the car slowdown distance, based on instantaneous car velocity, for decelerating the car, at said selected rate of jerk to said selected value of deceleration, calculating a slowdown table of ideal car velocities versus distances for such car slowdown distance, and calculating slowdown car velocity when selected deceleration is reached;

subtracting car slowdown distance from instantaneous target distance to determine stopping target distance;

comparing ideal stopping velocity, taken from said deceleration look-up table based upon stopping target distance, with said slowdown car velocity, for determining critical car distances for making stopping decisions;

recalculating, responsive to determination that the car has not reached a critical car distance, car slowdown distances, slowdown tables, and car slowdown velocities, based upon updated instantaneous car velocities, and comparing slowdown velocities with ideal stopping velocities, determined from updated instantaneous target distances, until a critical car distance is reached;

advancing, absent the detection, at said critical car distance, of a call signal at said target floor, said target floor to the next adjacent floor, and adding to instantaneous target distance the distance to the new target floor; and issuing, responsive to the detection, at said critical car distance, of a call signal at said target floor, signals representative of ideal velocities at selected instantaneous target distances, taken from said slowdown table and said deceleration table, for controlling car slowdown.

11. A method as defined in claim 10, wherein the step of determining instantaneous car velocities is carried out by storing an acceleration table containing values of ideal velocity, at selected time intervals, up to a selected maximum car velocity.

12. A method as defined in claim 11, comprising the step of outputting signals from said acceleration table, representative of ideal velocities, as speed correction signals, to said speed control means.

13. A method as defined in claim 12, comprising the step of correcting, responsive to the generation of each position signal, instantaneous target distance.

14. A method as defined in claim 13, wherein the means for generating position signals includes a synchronous positioning means having at least one stationary member between floors, and sensor means on said car for generating signals indicative of the next approaching floor, and instantaneous position signal means for indicating when the car is level with a floor.

15. A method as defined in claim 14, wherein said synchronous position indicating means includes means for generating a grey code series of numbers identifying respective floors, wherein sensor elements are provided between each floor for changing only one digit of a grey code sequence.

16. A method as defined in claim 13, comprising the step of selecting position indicators to designate dummy floors providing an express zone of travel therebetween.

17. A method as defined in claim 13, comprising the step of counting pulses between instantaneous position signals for correcting the stored values of distances between floors.

* * * * *